United States Patent [19]

Brown

[11] Patent Number: 4,620,537

[45] Date of Patent: Nov. 4, 1986

[54] COLD WEATHER FACE MASK

[76] Inventor: Thomas M. Brown, R.R. 12, Box 395, Muncie, Ind. 47302

[21] Appl. No.: 707,827

[22] Filed: Mar. 4, 1985

[51] Int. Cl.[4] ..... A62B 7/00

[52] U.S. Cl. ..... 128/201.13; 128/204.17

[58] Field of Search ..... 128/201.13, 204.17

[56] References Cited

U.S. PATENT DOCUMENTS

| | | | |
|---|---|---|---|
| 2,610,038 | 9/1952 | Phillips | 128/201.13 |
| 4,136,691 | 1/1979 | Ebeling et al. | 128/201.13 |
| 4,150,671 | 4/1979 | Tiger | 128/201.13 |
| 4,200,094 | 4/1980 | Gedeon et al. | 128/201.13 |
| 4,245,631 | 1/1981 | Wilkinson et al. | 128/204.17 |
| 4,318,398 | 3/1982 | Oetjen et al. | 128/201.13 |

FOREIGN PATENT DOCUMENTS

| | | | |
|---|---|---|---|
| 1364599 | 5/1964 | France | 128/201.13 |

*Primary Examiner*—Henry J. Recla

*Attorney, Agent, or Firm*—Woodard, Weikart, Emhardt & Naughton

[57] ABSTRACT

Described briefly, according to a typical embodiment of the present invention, a breathing mask is provided which has the intake air heater and heat and moisture exchange media located below the nose and situated for minimum exposure to heat transfer to the exterior. The mounting thereof is somewhat cantilevered from the mask, to minimize direct heat transfer to the exterior. Electric heating element means are provided and supplied from an energy pack mounted in the mask itself at a relatively low level. Some of the inhaled air passes through a first filter and moisture collecting medium to the mouth and/or nose of the individual wearing the mask. All inhaled air passes through a heat exchanger and a second filter and moisture exchanger. A valve is provided so that all air exhaled during normal respiration passes through both of the moisture exchangers. A second valve is provided in the wall of the mask to permit exhalation of any air exceeding that which can get through both of the exchangers during strenuous exercise and unusually high rates of respiration.

12 Claims, 3 Drawing Figures

COLD WEATHER FACE MASK

BACKGROUND OF THE INVENTION

1. Field of the Invention

This invention relates generally to respiratory apparatus, and more particularly to a face mask with means for tempering cold air for breathing.

2. Description of the Prior Art

It has been known for a long time that inhalation of cold air can be detrimental to health, the degree of detriment depending upon how much and how cold is the air, and the condition of the individual breathing it. In an effort to minimize the impact of low air temperature conditions, individuals living, working, and exercising have employed various devices in the past to minimize the impact of cold air. Such devices have ranged from simple scarfs to relatively simple face masks, to elaborate masks or breathing systems. Examples of some simple masks are shown in U.S. patents as follows: U.S. Pat. No. 3,333,585, Barghini et al., Aug. 1, 1967; U.S. Pat. No. 3,814,094, June 4, 1974, DeAngelis et al.; U.S. Pat. No. 4,325,365, Barbuto, Apr. 20, 1982; U.S. Pat. No. 4,136,691, Ebeling et al., Jan. 30, 1979; U.S. Pat. No. 4,196,728, Granite, Apr. 8, 1980.

More complex apparatus for the same purpose can be found in the following patents: U.S. Pat. No. 2,610,038, Phillips, Sept. 9, 1952; U.S. Pat. No. 3,326,214, June 20, 1967, McCoy; U.S. Pat. No. 3,249,108, May 3, 1966, Terman; U.S. Pat. No. 4,245,631, Wilkinson and Brown, Jan. 20, 1981. Phillips discloses use of exhaled air moisture storing means capable of returning heat and moisture to the incoming air. The McCoy apparatus is a more compact type using a different style of heat exchange element. The Terman patent is more elaborate in that it employs an electric heater in the mask and which is supplied with power from a rechargeable battery carried in a jacket pocket. The Wilkinson and Brown patent also has an electric heating element 40. It combines both the electric heating element and storage of heat from previously inhaled air, to heat subsequently inhaled air. Other devices are known for heating inhaled air. Bjurstrom U.S. Pat. No. 1,982,412 has a heater for use in therapy. It is intended for use in a building environment where one has access to an electric outlet.

Devices intended primarily for use by divers and heating heat and moisture regenerating means for tempering breathing mixtures are as follows: U.S. Pat. No. 3,747,598, Cowans, July 24, 1973 and U.S. Pat. No. 4,201,206, Kuehn et al., May 6, 1980. Apart from apparatus for treating cold air inhaled, there is a heated nasal inhaler U.S. Pat. No. 2,410,903 issued Nov. 12, 1946 to M. A. Rogge. A humidity exchanger is shown in U.S. Pat. No. 4,048,993 for use in anesthesia. A heat and moisture exchanger for use in anesthesia and artificial respiration is shown in U.S. Pat. No. 4,090,513 issued May 23, 1978 to Togawa. There remains a need for a simple apparatus optimizing the use of materials that enhance the performance of apparatus with a given power supply. The present invention is addressed to meeting that need.

SUMMARY OF THE INVENTION

Described briefly, according to a typical embodiment of the present invention, a breathing mask is provided which has an intake air heater and heat and moisture exchange media located below the nose and situated for minimum heat transfer from exhaled air to the environment. The mounting of the airway and heat and moisture conservation media is somewhat cantilevered from the mask, to minimize direct heat transfer to the exterior. Electric heating element means are provided in the mask and supplied electrically from an energy pack which may be mounted in the mask itself at a relatively low level. The incoming air flows primarily through a main passageway from the heating element means to a heat and moisture exchanging and filter medium and from there to the mouth and/or nose of the individual wearing the mask. An additional intake flow path is provided through a by-pass chamber containing a further heat and moisture exchanging and filter medium. A first one-way valve is provided in the main passageway between the electric heating element and the first-mentioned filter medium and is oriented to admit air to the mask. Exhaled air at normal flow rates is all diverted by the first valve to pass through the by-pass chamber, and can pass through both of the filter and heat and moisture exchanging media, whereupon heat and moisture from exhaled air can be conserved for delivery to air inhaled on the next breath, and thereby minimize the heat addition needed at the electric heating element. For high flow rates, and since the first valve is a one-way valve, any exhaled air in excess of what can be handled through the by-pass chamber, can exit through a second one-way (vent) valve which is provided in the wall of the mask. The first (intake) valve is adequate to handle all of the fresh air intake required for fresh air. So there is essentially no re-breathing of air, even at high flow rates, but exhaled air is used effectively during normal flow rates to provide needed heat and moisture addition to the incoming air.

DESCRIPTION OF THE PREFERRED EMBODIMENT

Figure 1:
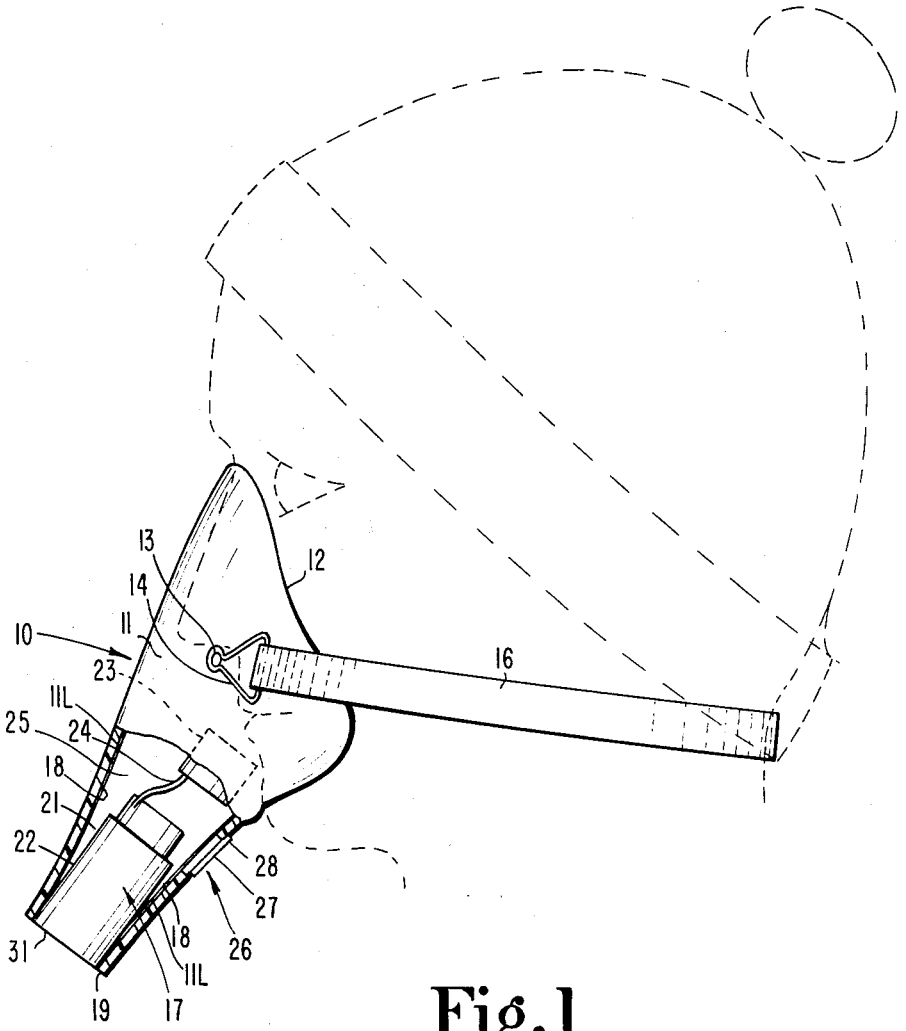
FIG. 1 is a side elevational view, partially in section, showing a mask according to a typical embodiment of the present invention.

Referring to the drawings in detail, mask 10 may have a flexible shell 11 of conventional material with an edge 12 to comfortably fit to the face in a conventional way. It has a pair of anchor posts 13 mounted on the mask at each side of the nose. Loops 14 attached to opposite ends of resilient strap 16 are hooked to the posts 13, to secure the mask to the face. It has a humidifier and heat exchanger assembly 17 which is secured to the interior wall 18 of the mask shell near the distal end 19 of the mask shell. By attaching the assembly 17 to the wall 18 over only a short distance from the end 19, thereby mounting the assembly 17 in a sort of cantilever fashion, there is a space 21 between the wall 18 and the outer surface 22 of the exchanger assembly, for most of the length of the assembly. In this way, there is no opportunity for direct heat transfer by conduction from the surface 22 to the mask wall, except at the area of cantilever attachment of the assembly body to the shell wall.

It is mentioned above that the flexible shell of the mask may be of conventional material. It is believed preferable if it is made of a synthetic material which, although windproof, is capable of "breathing" in order to minimize the chance for condensation of moisture inside the mask. An example of such material is Gortex. In addition, it is desirable to have a lining as at 11L of a good thermal insulator. An example is a 65% olefin 35% polyester fabric known as "Thinsulate". This Thinsulate material can also be used as a shell covering 30 on the assembly 17. It is conceivable that the lining 11L of the mask and the covering 30 of the assembly 17 can be glued together at the mounting area to provide the attachment of assembly 17 to mask shell 11 if the Thinsulate is tightly enough welded or otherwise attached to the shell 11 and body 29. Otherwise the Thinsulate material can be omitted at the cylindrical area of attachment of the body to the shell so that these parts can be glued directly together.

A combination battery pack, air temperature sensor, and temperature responsive heater control switch module 23 may be mounted on the inner wall of the mask, and electrically connected by wires 24 to the assembly 17. A one-way exhaust valve assembly 26 is provided in the wall of the mask at the underside thereof, just above the area of attachment of the assembly 17 to the wall. This valve assembly includes a circular flapper 27 which is attached at its upper end margin 28. It can be a rubber disk of a normally-closed type, and open downwardly in response to a certain level of pressure in the mask.

Figure 2:
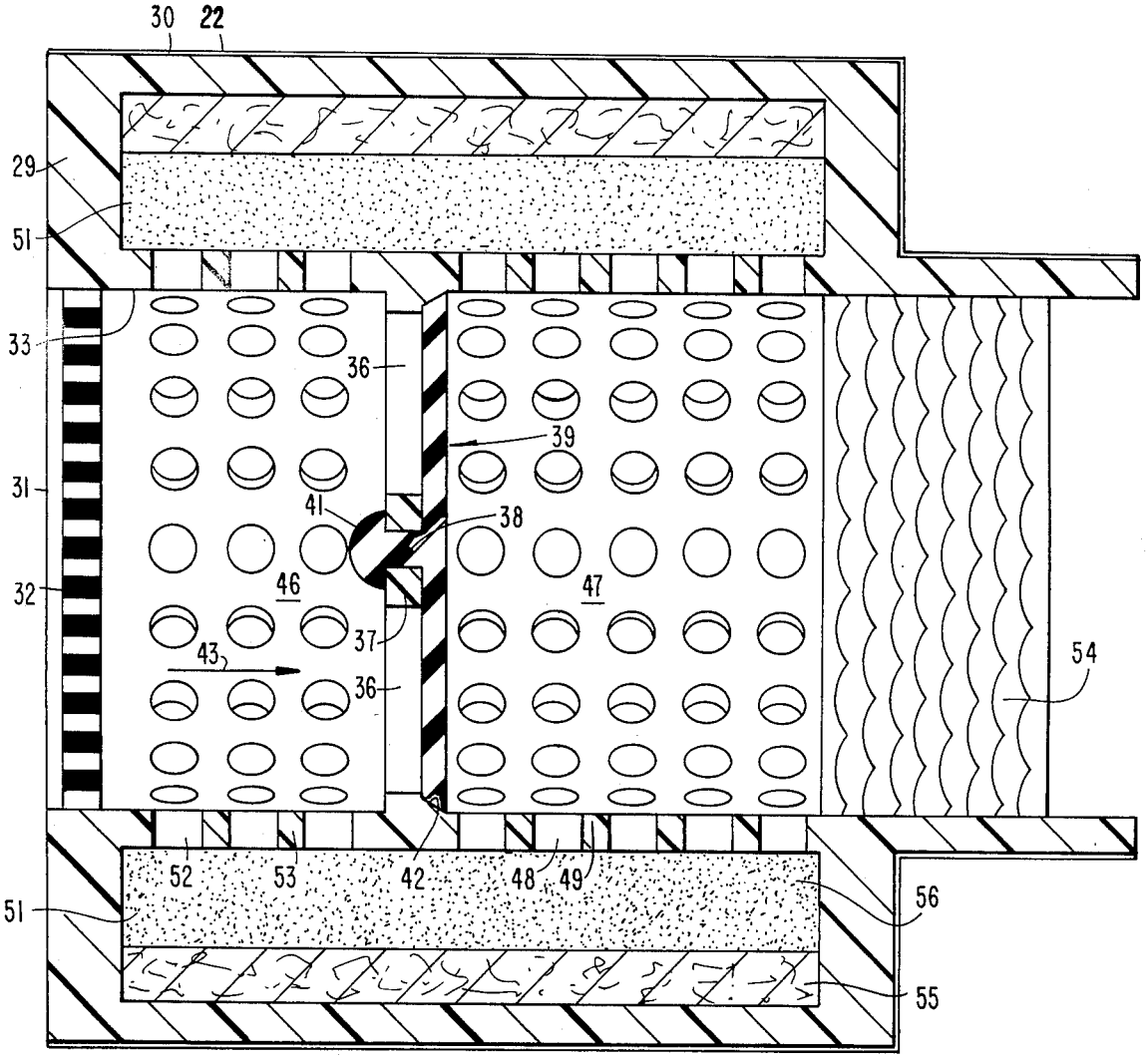
FIG. 2 is an enlarged longitudinal section through a portion of the mask and a combination heat and moisture exchanger.
Figure 3:
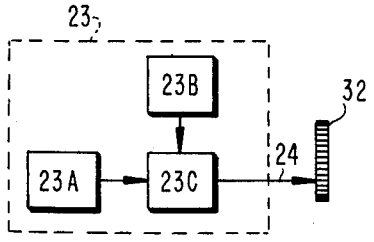
FIG. 3 is a block diagram of the electrical system.

Referring now to FIG. 2, the body 29 of the assembly 17 can be made primarily of plastic. The front or air-entrance end 31 is flush with the lower front end 19 of the mask shell as shown in FIG. 1. An electric heating element 32 is secured in the cylindrical wall 33 of the body, near the front end. The element is perforate to permit air to readily flow through it. It is connected to the power pack heat control 23 by the wires 24 (FIG. 1).

A valve support grid of spokes 36 is provided in the main passageway in the body 29. The spokes support a centrally located hub 37 to which the mounting stem 38 of a flapper valve 39 is mounted and retained by the integral knob 41 at the end of the stem. This valve can be made of an elastomeric material and normally seals on the bevel seat 42 formed in the body 29 and projecting inward from the cylindrical wall 33 of the body. Thus, although it freely admits air flowing in the direction 43, it prevents flow of air outward through the spoked apertures. It effectively divides the main passageway into chambers 46 and 47. This valve can be a prefabricated assembly including the seat ring, spokes, hub, and flapper, with the ring then adhesively attached, or thermally welded to the body 29. The same type of assembly can be used for the valve assembly 26, if desired. Other suitable valve constructions might also be used.

The body 29 has perforations 48 in the wall 49 of chamber 47. These provide communication between chamber 47 and an annular by-pass chamber 51 in body 29. Perforations 52 in wall 53 of chamber 46 provide communication between chamber 51 and chamber 46.

A combination heat and moisture exchanger medium 54 is secured in the body 29 such that all of the air flowing into the mask must pass through it. The material may be a lattice of stacked aluminum and fabric sheets such as disclosed in the above mentioned Togawa Pat. No. 4,090,513, wherein the aluminum is for the heat exchange feature, and the fabric is for the moisture exchange feature. Other materials may also be used. For example, in annular chamber 51, I would expect to use the material used in a Siemens-Elema AB of Sweden, Servo Humidifier 150 or 151. This item uses synthetic felt material to collect condensates from exhaled air, and a hygroscopic cellulose sponge for further water molecule removal when exhaled air passes through the surface area of the hygroscopic cellulose. I would use an annular sleeve 55 of synthetic felt and an annular ring 56 of hygroscopic cellulose sponge in chamber 51. Although it is desirable that my mask assembly be inexpensive enough to justify discarding it after a reasonable amount of use, it may be considered desirable to make materials of the media 54, 55, 56 of a bactericidal nature to facilitate prolonged use without risk of bacterial colonization.

Under normal breathing conditions, inhaled air can pass through both the valve 39 and the medium 56 in chamber 51 whereby some of the air in chamber 47 is humidified by the medium 56, but all of the air entering the mask chamber 25 is humidified by the additional humidification and heat provided in the medium 54. If the sensor at the battery pack-controller 23 senses that the temperature of the air in the mask chamber 25 is too low, it turns on the heater element 32 to add heat to the incoming air.

Where the rate of breathing of the user is high, adequate air entry is accommodated by the combination passages through the valve 39 and the medium 56, and is not impeded by the grid 32 at the front or the combination medium 54. That is to say that these features are designed with low enough flow resistance to avoid any labored breathing or discomfort, even at high breathing rates. However, since there is the valve 39 in the passage between chambers 46 and 47, any of the exhaled air that is to go through the body 29 must pass from chamber 47 through the perforations 48 in the wall 49, through annular chamber 51 and the moisture-exchanger humidifier medium 56 therein, through perforations 52 in wall 53 into chamber 46 and out through the heating element grid 32. Since the air discharge upon exhalation is confined to this route through medium 56, the exhaust valve 26 is provided in the mask wall itself to permit easy exhalation of air in excess of the capacity of the passageway through the medium 56.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A breathing mask comprising:

a shell adapted to mounting to the face of an individual to cover the nose and mouth;

a heat and moisture exchange assembly located inside the shell below the wearer's nose and situated for minimum exposure to heat conduction through the shell to the exterior of the mask, the assembly being elongate and cantilever-mounted to the mask shell, providing a perimetrical space between the shell and the assembly through most of the length of the assembly.

2. A breathing mask comprising:

a shell adapted to mounting to the face of an individual to cover the nose and mouth;

a heat and moisture exchange assembly located inside the shell below the wearer's nose and situated for minimum exposure to heat conduction through the shell to the exterior of the mask, electric heating element means in said assembly;

air temperature sensing means inside the shell of the mask;

a source of electrical energy; and control means coupled to said sensing means and between said energy source and said heating element means to control energy to the heating element means in response to the temperature of air inside the mask shell.

3. The mask of claim 2 wherein:

said energy source and said control means are in a module mounted to the inside wall of the mask shell.

4. A breathing mask comprising:

a shell adapted to mounting to the face of an individual to cover the nose and mouth;

a heat and moisture exchange assembly mounted inside the shell and including a body having an air entrance opening, a primary air intake passageway and an exhaust passageway, said exhaust passageway including part of said intake passageway and having moisture exchanging means therein; and first one-way valve means in said primary air intake passageway and oriented to permit flow directly from said air entrance opening in said assembly, through said primary air intake passageway into said shell, but divert flow from inside said shell through said moisture exchanging means out to said opening.

5. The mask of claim 4 wherein said shell has a wall with a wall portion spaced from said body, the mask further comprising:

second one-way valve means, said second valve means being located in said wall portion of said shell, and oriented to permit flow outward from said shell through said second valve means.

6. The mask of claim 5 wherein:

the location of said second valve means is on the underside of said shell.

7. A breathing mask comprising:

a shell adapted to mounting to the face of an individual to cover the nose and mouth;

a heat and moisture exchange assembly mounted to the shell and including a body having a primary air intake passageway and an exhaust passageway, said exhaust passageway including part of said intake passageway and having moisture exchanging means therein, said assembly including:

a generally cylindrical central passageway serving as said primary air intake passageway;

one-way valve means in said central passageway and dividing said passageway into two chambers;

annular passageway means around and coaxial with said central passageway and cooperating with said central passageway to provide said exhaust passageway;

aperture means in a wall of said body providing communication between said chambers and said annular passageway means; and moisture collecting and exchange means in said annular passageway means;

said one way valve means being oriented to cause exhaled air to pass primarily through said collecting means to store therein moisture from exhaled air and thereby enable delivery of collected moisture to incoming air before reaching the mouth and/or nose of the individual wearing the mask.

8. The mask of claim 7 wherein said moisture collecting and exchange means include concentric shells of hygroscopic cellulose and felt.

9. The mask of claim 7 and further comprising:

a second moisture collecting and exchange means in said central passageway adjacent the end of the assembly nearest the nose of the wearer of the mask and positioned so that all of the air entering the mask must pass through said second exchange means.

10. The mask of claim 9 and further comprising:

a heat exchange means at said second moisture exchange means to take heat from all the air exiting the mask through said assembly during exhalation by the wearer and return said heat to all the air entering the mask through said assembly during inhalation by the wearer.

11. The mask of claim 10 and further comprising:

electric heating means in the assembly and operable, when energized, to heat all air entering the mask upon inhalation.

12. The mask of claim 11 and further comprising:

temperature sensing electrical controller means inside the mask shell and coupled to the electrical heating means, and operable to sense the temperature of air entering the mask and control energization of the heating means in response to the temperature.

* * * * *